US012279664B2

(12) United States Patent
Locatelli

(10) Patent No.: US 12,279,664 B2
(45) Date of Patent: Apr. 22, 2025

(54) PROTECTIVE HELMET

(71) Applicant: Locatelli S.p.A., Almenno San Bartolomeo (IT)

(72) Inventor: Antonio Locatelli, Almenno San Salvatore (IT)

(73) Assignee: Locatelli S.p.A., Almenno San Bartolomeo (IT)

( * ) Notice: Subject to any disclaimer, the term of this patent is extended or adjusted under 35 U.S.C. 154(b) by 0 days.

(21) Appl. No.: 16/140,588

(22) Filed: Sep. 25, 2018

(65) Prior Publication Data

US 2019/0133233 A1 May 9, 2019

(30) Foreign Application Priority Data

Nov. 7, 2017 (IT) ..... 102017000126486

(51) Int. Cl.
*A42B 3/06* (2006.01)
*A42B 3/12* (2006.01)

(52) U.S. Cl.
CPC ..... *A42B 3/063* (2013.01); *A42B 3/064* (2013.01); *A42B 3/066* (2013.01); *A42B 3/069* (2013.01); *A42B 3/12* (2013.01)

(58) Field of Classification Search
CPC ..... A42B 3/063; A42B 3/064; A42B 3/066; A42B 3/069; A42B 3/12; A43B 3/06; A43B 3/062; A43B 3/065; A43B 3/10; A43B 3/064; A43B 3/04; A43B 3/16; A43B 3/32; A43B 3/324
USPC ..... 2/411
See application file for complete search history.

(56) References Cited

U.S. PATENT DOCUMENTS

| | | | |
|---|---|---|---|
| 3,430,261 | A | 3/1969 | Benner |
| 3,970,082 | A | 7/1976 | Leight |
| 4,027,341 | A | 6/1977 | Patteri |
| 4,104,743 | A | 8/1978 | Bottger |
| 4,391,000 | A | 7/1983 | Loennstedt |
| 4,944,361 | A | 7/1990 | Lindgren et al. |
| 5,208,951 | A | 5/1993 | Aoki |

(Continued)

FOREIGN PATENT DOCUMENTS

| | | | |
|---|---|---|---|
| CN | 102406262 | A | 4/2012 |
| CN | 105636469 | A | 6/2016 |

(Continued)

OTHER PUBLICATIONS

Ministry of Economic Development, Research Report, Jul. 9, 2018, pp. 1-2, Italy's Embassy in The Hague, Netherlands.

(Continued)

*Primary Examiner* — Uyen T Nguyen
(74) *Attorney, Agent, or Firm* — Patterson Intellectual Property Law, PC

(57) ABSTRACT

A protective helmet as disclosed herein, particularly for sport activities and the like, comprises an outer protective cap, a first outer protective shell positioned inside and coupled to said outer protective cap, a second inner protective shell positioned inside and coupled to said first outer protective shell, and coupling means between said first outer protective shell and said second inner protective shell. The coupling means comprise first damping means and second mechanical retaining means spaced apart from each other and positioned in corresponding seats of said first outer shell and second inner shell.

16 Claims, 4 Drawing Sheets

(56) References Cited

U.S. PATENT DOCUMENTS 5,546,610 A 8/1996 Herzig et al.
5,590,209 A 12/1996 Pratt et al.
5,742,937 A * 4/1998 Baudou ..... G02B 27/0176 2/6.3
6,735,306 B1 5/2004 Heinz
8,028,344 B2 10/2011 Rogers et al.
8,688,040 B2 4/2014 Jung
8,739,317 B2 * 6/2014 Abernethy ..... A42B 3/122 2/6.6
9,124,974 B2 9/2015 Flynn
9,125,449 B1 9/2015 Wagemans
9,572,388 B2 2/2017 Carroll
10,098,404 B2 10/2018 Morgan
10,362,829 B2 7/2019 Lowe
10,617,168 B2 4/2020 Winters et al.
10,779,601 B2 9/2020 Lanner et al.
10,912,344 B2 2/2021 Bohn et al.
10,959,477 B2 3/2021 Nordin et al.
11,337,484 B2 5/2022 Barber et al.
11,672,296 B2 6/2023 Rogers et al.
2004/0016089 A1 1/2004 Grunberger et al.
2004/0218776 A1 11/2004 Rolla
2005/0257312 A1 * 11/2005 Puchalski ..... A42B 3/064 2/411
2006/0057972 A1 3/2006 Wikel et al.
2008/0123892 A1 5/2008 Latti
2010/0275347 A1 11/2010 Baldackin
2011/0034217 A1 2/2011 Kushnirov
2011/0107503 A1 * 5/2011 Morgan ..... A42B 3/124 2/456
2012/0002046 A1 1/2012 Rapoport et al.
2012/0060251 A1 * 3/2012 Schimpf ..... A42B 3/064 2/5
2012/0148080 A1 6/2012 Kushnirov et al.
2012/0174294 A1 7/2012 Sackett
2013/0000015 A1 * 1/2013 Marzec ..... A42B 3/12 2/411
2013/0042397 A1 2/2013 Halldin
2013/0312161 A1 * 11/2013 Anderson ..... A41D 13/0155 2/413
2014/0000015 A1 1/2014 Arai
2014/0013491 A1 * 1/2014 Hoshizaki ..... A42B 3/12 2/411
2015/0089722 A1 * 4/2015 Berry ..... A42B 3/064 2/412
2015/0089724 A1 * 4/2015 Berry ..... A42B 3/064 2/414
2015/0157083 A1 * 6/2015 Lowe ..... A42B 3/128 2/412
2016/0088892 A1 3/2016 Sackett
2016/0100649 A1 4/2016 Glezerman et al.
2016/0316847 A1 * 11/2016 Weber ..... A42B 3/064
2016/0324248 A1 11/2016 Winters et al.
2017/0188649 A1 7/2017 Allen et al.
2017/0215507 A1 * 8/2017 Straus ..... A63B 71/10
2018/0077990 A1 * 3/2018 Straus ..... A42B 3/064
2018/0213874 A1 8/2018 Lanner et al.
2018/0235304 A1 8/2018 Fischer et al.
2019/0269193 A1 9/2019 Benyola et al.
2019/0320753 A1 10/2019 Le et al.
2021/0267300 A1 9/2021 Blomqvist

FOREIGN PATENT DOCUMENTS

CN 107249369 A 10/2017
CN 107847003 A 3/2018
EP 1142495 A1 10/2001
WO 20110139224 A1 11/2011
WO 2015085294 A1 6/2015
WO 20160209740 A1 12/2016

OTHER PUBLICATIONS

Ministry of Economic Development, Research Report, Jul. 11, 2018, pp. 1-3, Italy's Embassy in The Hague, Netherlands.
CNIPA: The First Office Action for corresponding Application No. 201811125465.4 dated Jul. 14, 2022.
Chinese Patent Office, Office Action, Apr. 11, 2023, 10 pages.

* cited by examiner 41
41
41
410
141
10
30
31
32
33
21
22
20
42
42
42

PROTECTIVE HELMET

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: Italian Patent Application No. 102017000126486 filed Nov. 7, 2017.

BACKGROUND

The present invention relates to a protective helmet, and more in particular to a protective helmet for sport activities, such as motorcycling, motocross, cycling, mountain biking, car racing, skiing/snowboarding and similar sports, having improved safety characteristics.

It is known that in given activities, for example in sport activities at high risk of accidents due to falls or impacts, such as motorcycling, motocross, cycling, car racing, mountain biking, skiing/snowboarding and similar sports, it is necessary to protect the head of the user to avoid, or at least to minimize, damage in the event of a fall or violent impact. For this purpose, there are normally provided protective helmets, of various shapes and with various characteristics according to use, the aim of which is in fact to protect the user's head from otherwise damaging impacts.

Known helmets normally consist of a rigid outer cap, normally coupled to which is a relatively soft and compressible inner protective shell, capable of absorbing the impact forces, minimizing impact damage to the user's head. However, when the force applied to the helmet exceeds the capacity of the helmet to reduce impacts, the energy is transferred to the user's head and brain, causing more or less severe lesions according to the residual impact energy.

Furthermore, although known helmets fulfill the purpose of preventing or limiting impact damage, they do not effectively protect the head from non-impact damage, i.e., stress and damage caused by sudden and violent accelerations or decelerations transmitted to the brain. In particular, these accelerations/decelerations can be both linear and rotational and, according to their intensity, can cause even very serious damage, such as subdural hematomas or diffuse lesions.

Therefore, it would be desirable to provide a protective helmet, and more in particular a protective helmet for sport activities, such as motorcycling, motocross, cycling, car racing, mountain biking, skiing/snowboarding and similar sports, which is able to solve the aforesaid problems.

BRIEF SUMMARY

Therefore, an object of the present invention is to provide a protective helmet, in particular for sport activities, such as motorcycling, motocross, cycling, mountain biking, car racing, skiing/snowboarding and similar sports, which is able to minimize impact risk and damage to the user's head.

A further object of the present invention is to provide a protective helmet, in particular for sport activities such as motorcycling, motocross, cycling, mountain biking, car racing, skiing/snowboarding and similar sports, which is able to minimize both linear and rotational accelerations that are transmitted to the head and to the brain of a user in the event of a violent impact.

Yet another object of the present invention is to provide a protective helmet, in particular for sport activities such as motorcycling, motocross, cycling, mountain biking, car racing, skiing/snowboarding and similar sports, which has a limited number of components.

One more object of the present invention is to provide a protective helmet, in particular for sport activities, such as motorcycling, motocross, cycling, mountain biking, car racing, skiing/snowboarding and similar sports, which is easy to manufacture at competitive costs.

This requirement is met with the solution provided by the present invention, which relates to a protective helmet, in particular a protective helmet for sport activities such as motorcycling, motocross, cycling, mountain biking, car racing, skiing/snowboarding and similar sports, of improved type with respect to known helmets.

Therefore, the subject-matter of the present invention is a protective helmet, particularly for sport activities, such as motorcycling, motocross, cycling, mountain biking, car racing, skiing/snowboarding and similar sports, which comprises an outer protective cap, a first outer protective shell positioned inside and coupled to said outer protective cap, a second inner protective shell positioned inside and coupled to said first outer protective shell, and coupling means between said first outer protective shell and said second inner protective shell. The protective helmet according to the present invention is characterized in that said coupling means comprise first damping means and second mechanical retaining means that are spaced apart from each other and positioned in corresponding seats of said first outer shell and second inner shell.

In this way, it is possible to obtain a protective helmet that fully satisfies the aforesaid objects, with tangential reduction of the rotational kinetic impact energy transmitted to the user's head.

In practice, the theoretical assumption is that when a rigid body rotates about a fixed or in any case constrained axis, each point therefore has a given tangential speed that depends on the period and on its distance from the rotation axis according to the laws of rotational kinematics.

Therefore, after an impact, each point of the moving element (helmet) has kinetic energy.

If we consider as fixed rotation axis the theoretical axis passing through the neck of the driver and as pivot point the central position of retention given by the strap, after an impact (for example in the event of a fall) the rotating element consists of the helmet (intended as deformable element in accordance with the safety regulations in force). Therefore, the residual energy is transferred from the helmet to the user's head as resultant of the normal to the pivot projected on the inner surface of the shell in contact with the skin.

By dividing the rotating object (helmet) into two parts (first outer protective shell and second inner protective shell) and interposing an energy absorber made of a damping material, it is possible to obtain an inertial reduction of this element (according to the rotational and non-linear degrees of freedom). Therefore, the resultant will be greatly advantageous in terms of tangential reduction of the rotational kinetic impact energy.

In other words, due to the division of the protective shell into two shells (first outer protective shell and second inner protective shell) joined by damping means, there is a considerable reduction of the rotational kinetic impact energy transmitted to the user's head, for example in the event of a fall, with consequent reductions of the risk of brain damage mentioned previously.

The further considerable advantage to be considered is given by the fact that the first outer protective shell and the second inner protective shell can be made of different materials and/or densities, so as to increase the general impact strength of the helmet and/or create differentiated areas in terms of impact resistance.

In a greatly preferred embodiment of a protective helmet, particularly for sport activities and the like, according to the present invention, said first damping means comprise at least one ring-shaped damping element made of elastomeric material, for example made of a silicone material or similar elastomers.

The shape and the size of the ring made of elastomeric material can vary according to requirements, as can its positioning at the interface between said first outer protective shell and said second inner protective shell.

For example, the ring made of elastomeric material can advantageously have a substantially circular shape and be positioned at the top of the helmet, substantially centered with respect to the theoretical rotation axis passing through the neck of the driver described previously.

From a constructional viewpoint, in a preferred embodiment of the protective helmet, particularly for sport activities and the like, according to the present invention, said at least one ring-shaped damping element made of elastomeric material has an outer crown and an inner crown that are solidly coupled respectively to one or to the other of said first outer protective shell and second inner protective shell.

In practice, in a first embodiment of a protective helmet, particularly for sport activities and the like, according to the present invention, said first outer shell advantageously comprises a first seat for housing said at least one ring-shaped damping element made of elastomeric material having a support surface and a first inner edge, while said second inner shell comprises a first protuberance having a first outer edge inserted into said at least one ring-shaped damping element made of elastomeric material.

In this case, said first inner edge of said first seat is solidly coupled to the outer crown of said at least one ring-shaped damping element made of elastomeric material, for example by gluing or similar fixing methods, while said first outer edge of said first protuberance is solidly coupled to the inner crown of said at least one ring-shaped damping element made of elastomeric material, for example by gluing or similar fixing methods.

In an alternative embodiment to the preceding embodiment of a protective helmet, particularly for sport activities and the like, according to the present invention, said second inner shell instead comprises a second seat for housing said at least one ring-shaped damping element made of elastomeric material having a support surface and a second inner edge, and said first outer shell comprises a second protuberance having a second outer edge inserted in said at least one ring-shaped damping element made of elastomeric material.

In this case, said second inner edge of said second seat is solidly coupled to the outer crown of said at least one ring-shaped damping element made of elastomeric material, for example by gluing or similar fixing methods, while said second outer edge of said second protuberance is solidly coupled to the inner crown of said at least one ring-shaped damping element made of elastomeric material, for example by gluing or similar fixing methods.

As mentioned above, one of the peculiar characteristics of the protective helmet, particularly for sport activities and the like, according to the present invention, is given by the fact that said second inner shell is movable relative to said first outer shell and by the fact that said second mechanical retaining means allow partial rotation or roto-translation of said second inner shell with respect to said first outer shell.

In practice, in the helmet according to the present invention, the second inner shell is free to rotate or to carry out a roto-translation movement, with respect to the first outer shell and with respect to the axis passing through the center of the ring-shaped damping element made of elastomeric material, within given limits. These limits, which are typically a few millimeters (for example ±5 mm), are guaranteed by the presence of the second mechanical retaining means that are separated, structurally and spatially, from the ring-shaped damping element made of elastomeric material.

In a particular embodiment of a protective helmet, particularly for sport activities and the like, according to the present invention, said second mechanical retaining means comprise for example a male element, which is provided with snap-locking means and is positioned in a corresponding seat of one between said first outer shell and second inner shell and extends through the first outer protective shell and the second inner protective shell. The second mechanical retaining means further comprise a female element, which is adapted to engage said snap-locking means of said male element and is positioned in a corresponding seat of the other between said first outer shell and second inner shell.

In this way, it is possible to simply and rapidly produce a mechanical retention between the first outer shell and the second inner shell, while at the same time maintaining the degrees of freedom required to guarantee the limited relative movement between said first outer shell and said second inner shell. However, other alternative mechanical retention methods to the one described herein are possible according to requirements.

From a constructional point of view, the absorption efficiency of the rotational energy on a protective helmet, particularly for sport activities and the like, according to the present invention, can be guaranteed by a single ring-shaped damping element made of elastomeric material suitably positioned at the interface between said first outer protective shell and said second inner protective shell and by one or more of said second mechanical retaining means.

However, in general, a protective helmet, particularly for sport activities and the like, according to the present invention, can advantageously comprise a plurality of said first damping means and/or a plurality of said second mechanical retaining means.

In a particularly preferred embodiment of the protective helmet, particularly for sport and similar activities, according to the present invention, said coupling means further comprise second damping means comprising one or more strips made of elastomeric material.

Advantageously, one or more of said strips made of elastomeric material are at least partially housed in grooves positioned on said first outer protective shell 10 and/or on second inner protective shell 20.

Alternatively to, or in combination with, the previously described embodiment, one or more of said strips made of elastomeric material can be advantageously positioned on the surface of said first outer protective shell 10 and/or of second inner protective shell 20.

Thus, in general, a protective helmet, particularly for sport activities and the like, according to the present invention, can advantageously comprise a plurality of said first damping means and/or a plurality of said second damping means and/or a plurality of said second mechanical retaining means.

BRIEF DESCRIPTION OF THE SEVERAL VIEWS OF THE DRAWINGS

Further characteristics and advantages of a protective helmet, particularly for sport activities, such as motorcycling, motocross, cycling, mountain biking, car racing, skiing/snowboarding and similar sports, according to the present invention, will be more apparent from the description of preferred embodiments, illustrated by way of non-limiting examples in the accompanying figures, wherein.

DETAILED DESCRIPTION

Figure 1:
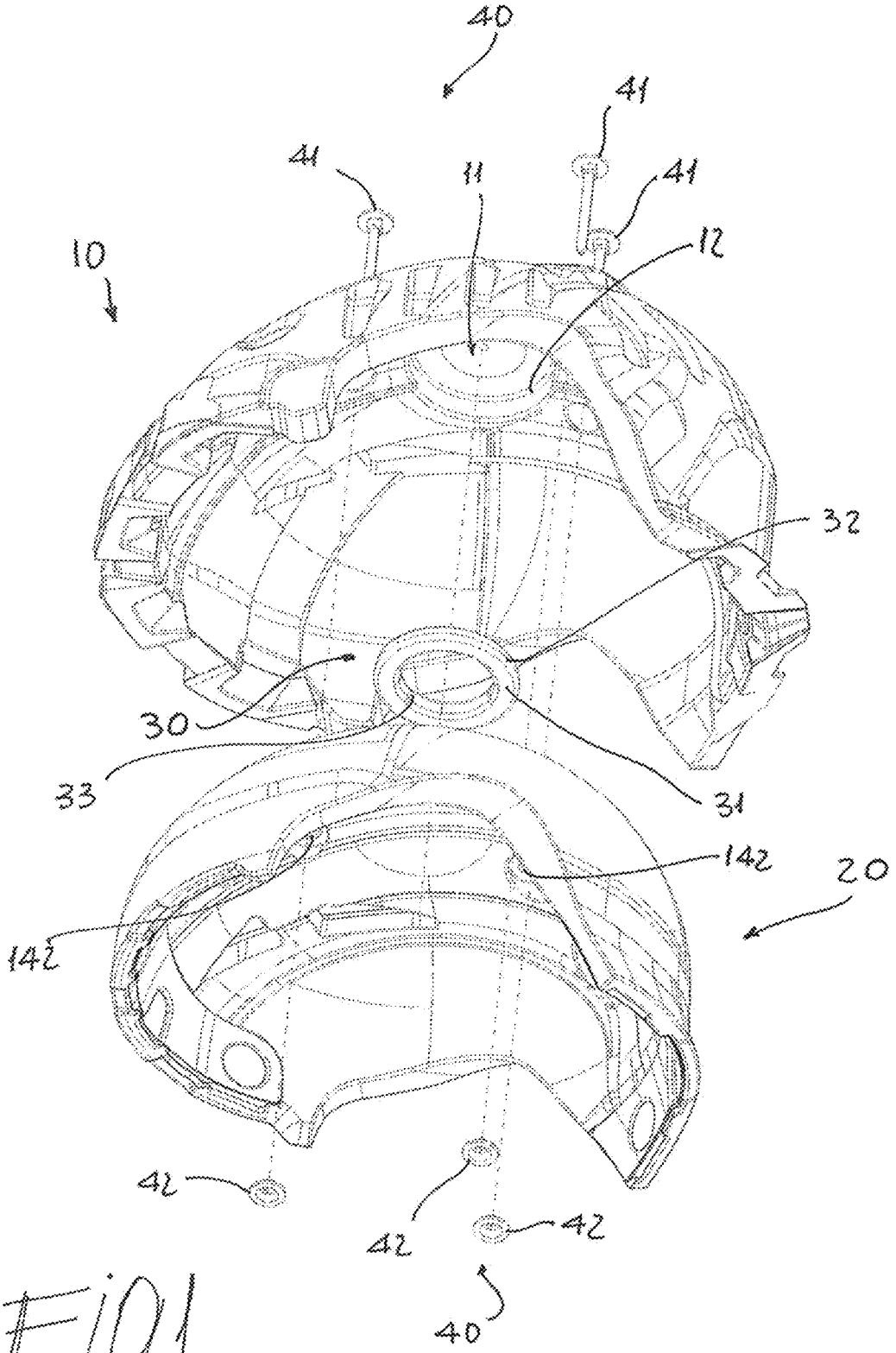
FIG. 1 is a first exploded perspective view of an assembly comprising a first outer protective shell and a second inner protective shell of a protective helmet according to the present invention.
Figure 2:
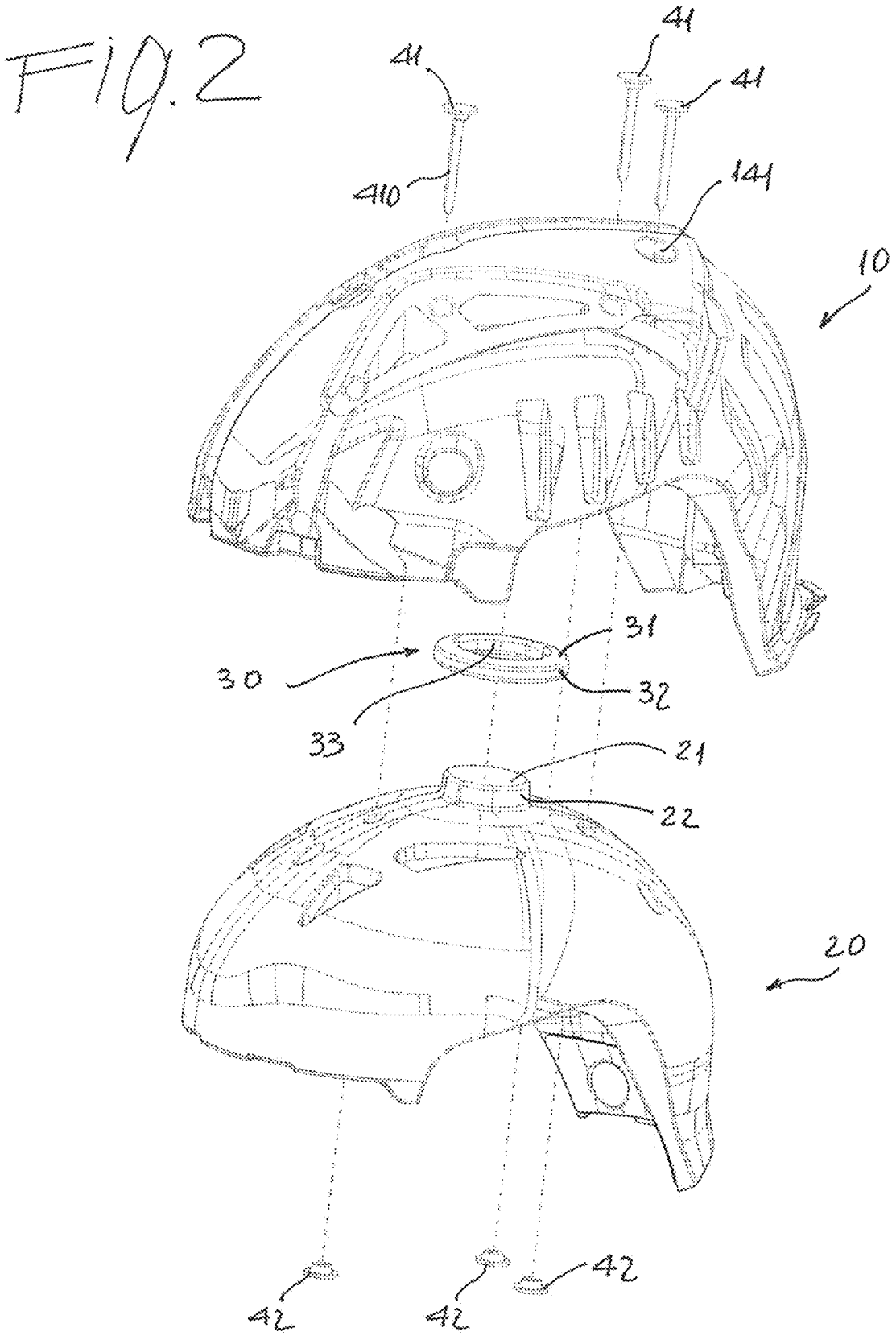
FIG. 2 is a second exploded perspective view of an assembly comprising a first outer protective shell and a second inner protective shell of a protective helmet according to the present invention.
Figure 3:
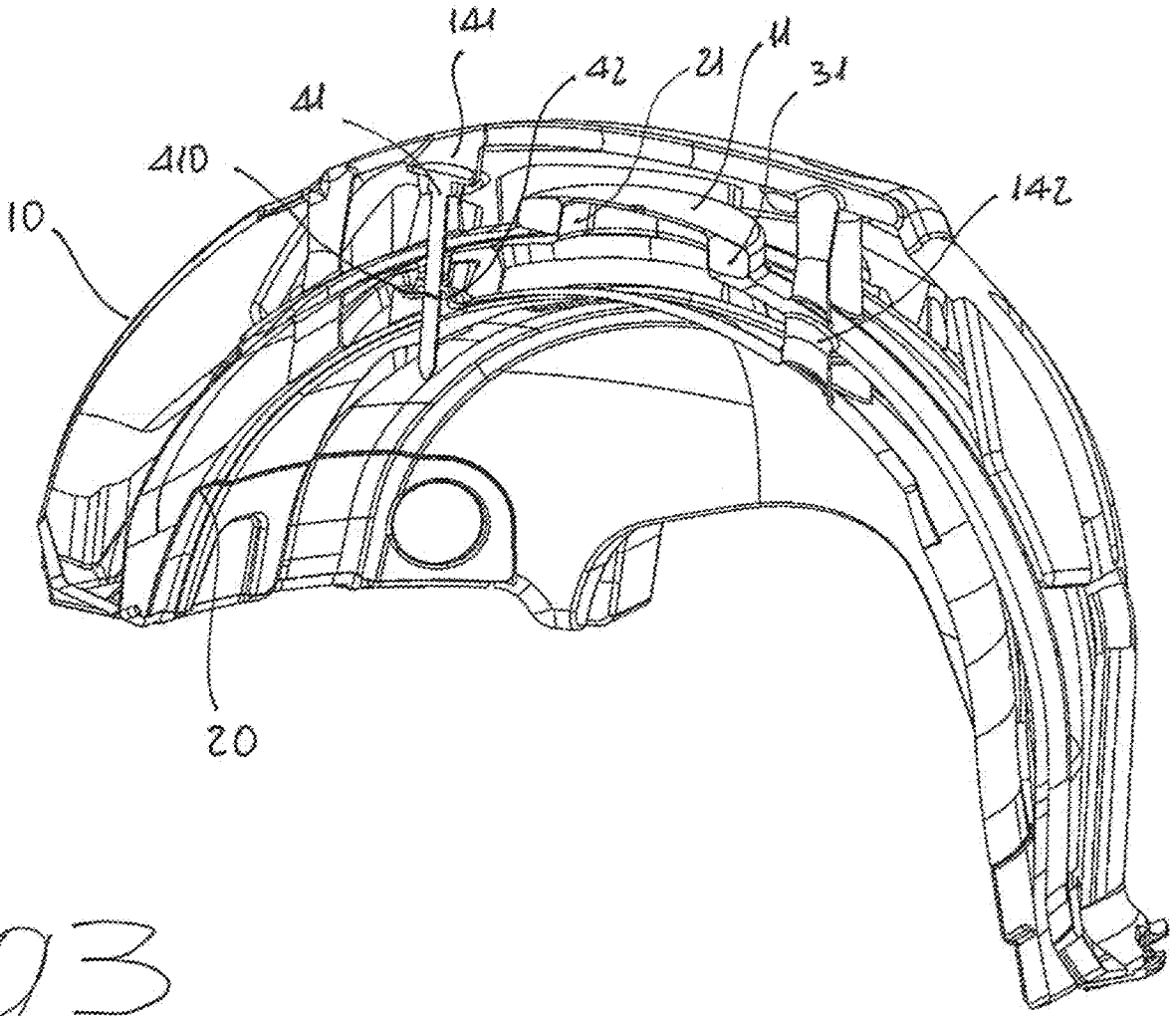
FIG. 3 is a first sectional view of an assembly comprising a first outer protective shell and a second inner protective shell of a protective helmet according to the present invention.
Figure 4:
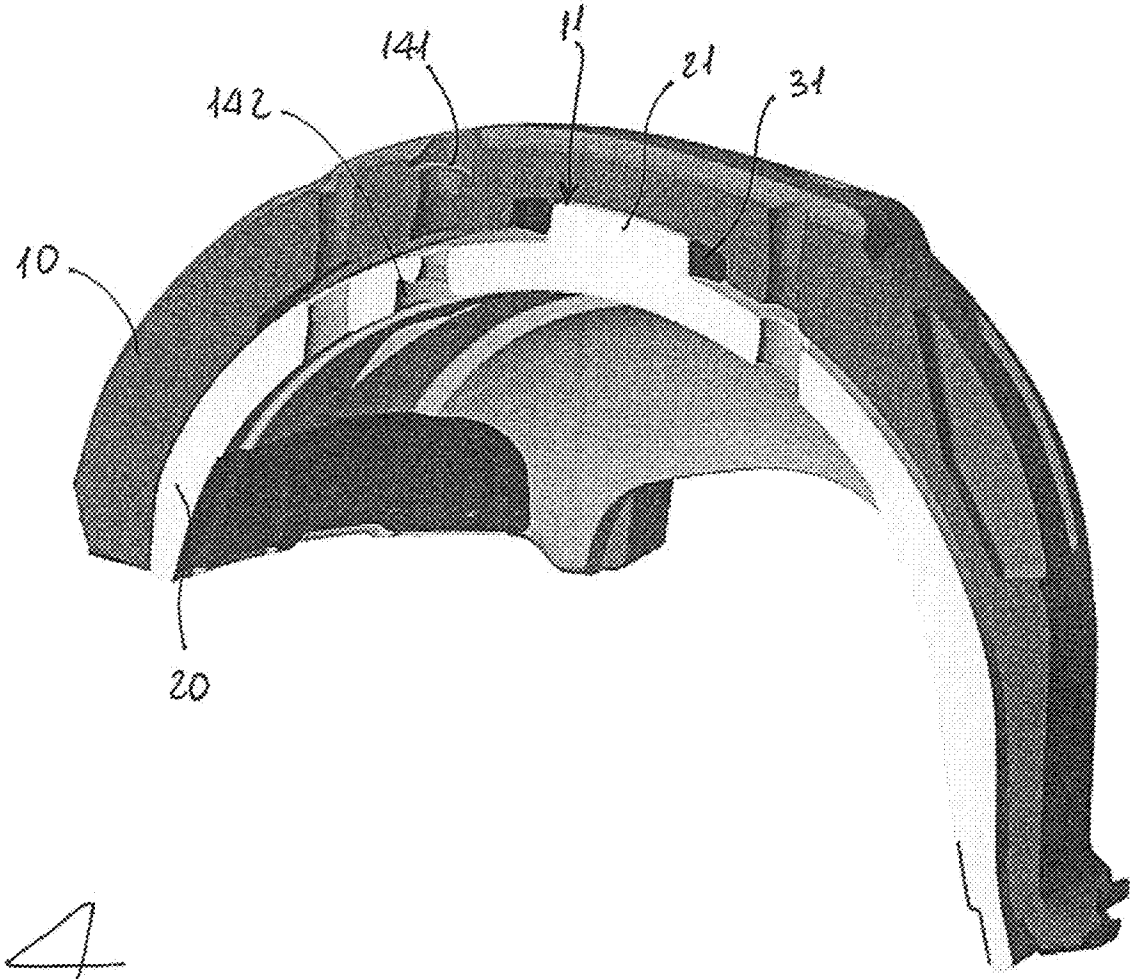
FIG. 4 is a second sectional view of an assembly comprising a first outer protective shell and a second inner protective shell of a protective helmet according to the present invention.

With reference to the accompanying figures, a protective helmet, particularly for sport activities such as motorcycling, motocross, cycling, mountain biking, car racing, skiing/snowboarding and the like sport, according to the present invention, comprises—in its most general embodiment—an outer protective cap (not illustrated for simplicity in the accompanying figures) usually made of rigid material.

The helmet according to the present invention further comprises a first assembly comprising a first outer protective shell 10, which is positioned inside said outer protective cap and is solidly coupled thereto. Said first assembly further comprises a second inner protective shell 20, which is positioned inside said first outer protective shell 10 and is coupled thereto according to methods described below.

The first 10 and second 20 shell are advantageously made with soft and compressible materials capable of absorbing at least part of the forces in the event of a collision or violent impact. Typically, the first 10 and second 20 shell are made of expanded polymer materials, for example expanded polystyrene, polypropylene or polyurethane, or silicon materials. Furthermore, said first 10 and second 20 shell can be made of the same material or with different materials, according to requirements.

Said first assembly of said protective helmet further comprises coupling means 30, 40 between said first outer protective shell 10 and said second inner protective shell 20 that are of particular type.

One of the peculiar characteristics of the protective helmet according to the present invention is in fact given by the fact that said coupling means 30, 40 comprise first damping means 30 and second mechanical retaining means 40 that are spaced apart from each other and positioned in corresponding seats 11, 21, 141, 142 of said first outer shell 10 and of said second inner shell 20.

In particular, in the embodiment of the protective helmet for sport activities illustrated in the accompanying figure, said first damping means 30 comprise at least one ring-shaped damping element 31 made of elastomeric material, for example a silicone material or similar elastomeric materials.

In the embodiment of the protective helmet illustrated here, the ring-shaped damping element 31 made of elastomeric material has a shape that is preferably substantially circular, so as to guarantee omnidirectional and isotropic absorption of the rotational kinetic energy transmitted following an impact. However, other geometries are also possible, according to requirements.

From a point of view of production, said at least one ring-shaped damping element 31 made of elastomeric material advantageously has an outer crown 32 that is solidly coupled, for example by gluing or similar fixing systems, to one of said first outer protective shell 10 or second inner protective shell 20. The ring-shaped damping element 31 made of elastomeric material advantageously also has an inner crown 33 that is solidly coupled, for example again by gluing or similar fixing systems, to the other of said first outer protective shell 10 or second inner protective shell 20.

In the embodiment of a protective helmet according to the present invention illustrated in the accompanying figures, said first outer shell 10 comprises a first seat 11 for housing said at least one ring-shaped damping element 31 made of elastomeric material, said seat having a support surface and a first inner edge 12. In turn, said second inner shell 20 instead comprises a first protuberance 21 having a first outer edge 22 inserted into said at least one ring-shaped damping element 31 made of elastomeric material.

As illustrated in the accompanying figures, in this case said first inner edge 12 of said first seat 11 is solidly coupled, for example by gluing, to the outer crown 32 of said at least one ring-shaped damping element 31 made of elastomeric material, while said first outer edge 22 of said first protuberance 21 is solidly coupled, for example again by gluing, to the inner crown 33 of said at least one ring-shaped damping element 31 made of elastomeric material.

In this way, a damping interface is produced between said first outer shell 10 and said second inner shell 20, which allows partial rotation or roto-translation of said second inner shell 20 with respect to said first outer shell 10, about an axis passing substantially through the center of the ring-shaped damping element 31 made of elastomeric material.

Instead, in an alternative embodiment of a protective helmet according to the present invention, not illustrated in the figures, said second inner shell 20 comprises a second seat for housing said at least one ring-shaped damping element 31 made of elastomeric material, said seat having a support surface and a second inner edge. In turn, said first outer shell 10 comprises a second protuberance having a second outer edge inserted into said at least one ring-shaped damping element 31 made of elastomeric material.

In this case, said second inner edge of said second seat is solidly coupled, for example by gluing, to the outer crown 32 of said at least one ring-shaped damping element 31 made of elastomeric material, and said second outer edge of said second protuberance is solidly coupled, for example again by gluing, to the inner crown 33 of said at least one ring-shaped damping element 31 made of elastomeric material.

In practice, in this way the same damping interface between first outer shell 10 and second inner shell 20 described above is produced, with the difference that seat and protuberance are positioned in the opposite way on said first outer shell 10 and said second inner shell 20 with respect to the previous case.

As mentioned above, in the assembly thus produced said second inner shell 20 is movable relative to said first outer shell 10 being able to carry out a partial rotation or roto-translation with respect to said first outer shell 10 about an axis that passes substantially through the center of the ring-shaped damping element 31 made of elastomeric material.

This is made possible by the fact that the second mechanical retaining means 40 on the one hand guarantee the stability of the assembly and the mechanical coupling between said first outer shell 10 and said second inner shell 20, and at the same time allow partial rotation or roto-translation of said second inner shell 20 with respect to said first outer shell 10. Typically, the relative movement of said second inner shell 20 with respect to said first outer shell 10 is of the order of a few millimeters, for example ±5 mm.

The mechanical retaining means 40 can be of different type according to requirements, provided they are able to guarantee mechanical stability and the possibility of mechanical relative movement between said first outer shell 10 and said second inner shell 20 described above.

For example, in the embodiment of a protective helmet, particularly for sport activities and the like, according to the present invention, illustrated in the accompanying figures, said second mechanical retaining means 40 advantageously comprise a male element 41 provided with snap-locking means 410 and positioned in a corresponding seat 141 in said first outer shell 10 and extending through the first outer protective shell 10 and the second inner protective shell 20. The second mechanical retaining means 40 further comprise a female element 42 adapted to engage said snap-locking means 410 of said male element 41 and positioned in a corresponding seat 142 in said second inner shell 20. Even if not illustrated, it is obviously possible to position the male element 41 in a seat in said second inner shell 20 and the female element 42 in a seat in said first outer shell 10.

In this way, it is possible to produce an efficient and rapid mechanical connection between said first outer shell 10 and said second inner shell 20 from the point of view of assembly, thus simplifying construction procedures and consequently reducing costs.

In the embodiment illustrated in the accompanying figures, the absorption efficiency of the rotational energy on the protective helmet, according to the present invention, is guaranteed by a single ring-shaped damping element 31 made of elastomeric material positioned on the top of the helmet, substantially at the axis passing through the neck of the user, while mechanical retention is guaranteed by three pairs of male elements 41 and female elements 42 appropriately positioned around said ring-shaped damping element 31 made of elastomeric material. Each of the male elements 41 defines a longitudinal axis, where the longitudinal axis of each of the male elements is substantially parallel to the rotation axis.

However, more in general and according to requirements, a protective helmet, particularly for sport activities and the like according to the present invention, can comprise a plurality of said first damping means 30 and/or a plurality of said second mechanical retaining means 40, appropriately positioned at the interface between said first outer shell 10 and said second inner shell 20.

In practice, it has been seen, as is apparent from the description and from the accompanying drawings, that the technical solutions adopted in the protective helmet for sport activities, such as motorcycling, motocross, cycling, mountain biking, car racing, skiing/snowboarding and similar sports, according to the present invention, allow the intended tasks and objects to be fully implemented.

On the basis of the description provided, other characteristics, modifications or improvements are possible and evident to a person skilled in the art. These characteristics, modifications and improvements should therefore be considered a part of the present utility model. In practice, the materials used, the dimensions and contingent shapes can be any according to requirements and to the state of the art.

What is claimed is:

1. A protective helmet, comprising:

an outer protective cap;

a first outer protective shell positioned inside and coupled to said outer protective cap;

a second inner protective shell positioned inside and coupled to said first outer protective shell; and coupling means between said first outer protective shell and said second inner protective shell, said coupling means comprising a first damping means and a plurality of second mechanical retaining means, the coupling means spaced apart from each other and positioned in corresponding seats of said first outer protective shell and second inner protective shell;

said first damping means positioned at a top portion of the helmet and comprising at least one ring-shaped damping element made of elastomeric material, the at least one ring-shaped damping element defining a rotational axis through an open center of, and substantially orthogonal to a longitudinal axis of the at least one ring-shaped damping element, the at least one ring-shaped damping element fixed on a first side to the first outer protective shell and fixed on a second side to the second inner protective shell;

said plurality of second mechanical retaining means for allowing partial rotation or roto-translation of said second inner protective shell with respect to said first outer protective shell and further with respect to the rotational axis through the open center of the at least one ring-shaped damping element;

each of said plurality of second mechanical retaining means comprising a male element provided with snap-locking means positioned in a corresponding seat of one of said first outer protective shell or second inner protective shell and extending through the first outer protective shell and the second inner protective shell, and a female element suitable for engaging said snap-locking means of said male element and positioned in a corresponding seat of the other between said first outer protective shell or second inner protective shell;

the male element of each of the plurality of second mechanical retaining means defining a longitudinal axis, wherein the longitudinal axis of the male element of each of the plurality of second mechanical retaining means is substantially parallel to the rotational axis.

2. The protective helmet of claim 1, wherein said at least one ring-shaped damping element made of elastomeric material has an outer crown and an inner crown securely coupled respectively to one or the other of first outer protective shell and said second inner protective shell.

3. The protective helmet of claim 2, wherein said first outer protective shell comprises a first seat for housing said at least one ring-shaped damping element made of elastomeric material having a support surface and a first inner edge, and said second inner protective shell comprises a first protuberance having a first outer edge inserted into the open center of said at least one ring-shaped damping element made of elastomeric material.

4. The protective helmet of claim 3, wherein said first inner edge of said first seat is solidly coupled to the outer crown of said at least one ring-shaped damping element made of elastomeric material, and said first outer edge of said first protuberance is solidly coupled to the inner crown of said at least one ring-shaped damping element made of elastomeric material.

5. The protective helmet of claim 2, wherein said second inner protective shell comprises a second seat for housing said at least one ring-shaped damping element made of elastomeric material having a support surface and a second inner edge, and said first outer protective shell comprises a second protuberance having a second outer edge inserted into the open center of said at least one ring-shaped damping element made of elastomeric material.

6. The protective helmet of claim 5, wherein said second inner edge of said second seat is solidly coupled to the outer crown of said at least one ring-shaped damping element made of elastomeric material and said second outer edge of said second protuberance is solidly coupled to the inner crown of said at least one ring-shaped damping element made of elastomeric material.

7. The protective helmet of claim 1, wherein said second inner protective shell is movable relative to said first outer protective shell and in that said plurality of second mechanical retaining means allow partial rotation or roto-translation of said second inner protective shell with respect to said first outer protective shell.

8. The protective helmet of claim 1, further comprising a plurality of said first damping means and/or a plurality of second damping means and/or the plurality of said second mechanical retaining means.

9. A protective helmet, comprising:

an outer protective cap;

a first outer protective shell positioned inside and coupled to said outer protective cap;

a second inner protective shell positioned inside and coupled to said first outer protective shell;

at least one ring-shaped damping element made of elastomeric material and positioned at a top portion of the protective helmet, having an outer crown and an inner crown securely coupled respectively to one or the other of the first outer protective shell and said second inner protective shell, the at least one ring-shaped damping element having a center hole defining a rotational axis there through and substantially orthogonal to a longitudinal axis of the at least one ring-shaped damping element;

a plurality of male elements provided with snap-locking means positioned in first corresponding seats of one of said first outer protective shell or second inner protective shell and extending through the first outer protective shell and the second inner protective shell, the first corresponding seats spaced apart from the coupling of the at least one ring-shaped damping element to the one of said first outer protective shell or second inner protective shell;

each of the plurality of the male elements defining a longitudinal axis, wherein the longitudinal axis of each of the plurality of male elements is substantially parallel to the rotational axis;

a corresponding plurality of female elements suitable for engaging said snap-locking means of said plurality of male elements and positioned in second corresponding seats of the other between said first outer protective shell or second inner protective shell, the second corresponding seats spaced apart from the coupling of the at least one ring-shaped damping element to the other of said first outer protective shell or second inner protective shell;

wherein said second inner protective shell is movable relative to said first outer protective shell and in that said plurality of male and female elements allow partial rotation or roto-translation of said second inner protective shell with respect to said first outer protective shell and further with respect to the rotational axis through the center hole of the at least one ring-shaped damping element.

10. The protective helmet of claim 9, wherein said first outer protective shell comprises a third seat for housing said at least one ring-shaped damping element having a support surface and a first inner edge, and said second inner protective shell comprises a first protuberance having a first outer edge inserted into the center hole of said at least one ring-shaped damping element made of elastomeric material.

11. The protective helmet of claim 10, wherein said first inner edge of said third seat is solidly coupled to the outer crown of said at least one ring-shaped damping element, and said first outer edge of said first protuberance is solidly coupled to the inner crown of said at least one ring-shaped damping element.

12. The protective helmet of claim 9, wherein said second inner protective shell comprises a fourth seat for housing said at least one ring-shaped damping element having a support surface and a second inner edge, and said first outer protective shell comprises a second protuberance having a second outer edge inserted into said at least one ring-shaped damping element.

13. The protective helmet of claim 12, wherein said second inner edge of said fourth seat is solidly coupled to the outer crown of said at least one ring-shaped damping element and said second outer edge of said second protuberance is solidly coupled to the inner crown of said at least one ring-shaped damping element.

14. A protective helmet, particularly for sport activities, comprising:

an outer protective cap;

a first outer protective shell positioned inside and coupled to said outer protective cap;

a second inner protective shell positioned inside and coupled to said first outer protective shell; and coupling means between said first outer protective shell and said second inner protective shell, said coupling means comprising at least one toroid-shaped damping element defining a rotational axis through a center opening of the at least one toroid-shaped damping element, and substantially orthogonal to a longitudinal axis of the at least one toroid-shaped damping element, the at least one toroid-shaped damping element positioned between the first outer protective shell and the second inner protective shell, wherein said at least one toroid-shaped damping element made of elastomeric material has an outer crown and an inner crown securely coupled respectively to one or the other of first outer protective shell and said second inner protective shell;

said coupling means further comprising a plurality of second mechanical retaining means for allowing partial rotation or roto-translation of said second inner protective shell with respect to said first outer protective shell and further with respect to the rotational axis through the center opening of the at least one toroid-shaped damping element;

each of said plurality of second mechanical retaining means comprising a male element provided with snap-locking means positioned in a corresponding seat of one of said first outer protective shell or second inner protective shell and extending through the first outer protective shell and the second inner protective shell, and a female element suitable for engaging said snap-locking means of said male element and positioned in a corresponding seat of the other between said first outer protective shell or second inner protective shell;

the male element of each of the plurality of second mechanical retaining means defining a longitudinal axis, wherein the longitudinal axis of the male element of each of the plurality of second mechanical retaining means is substantially parallel to the rotational axis.

15. The protective helmet of claim 14, wherein said first outer protective shell comprises a first seat for housing said at least one toroid-shaped damping element having a support surface and a first inner edge, and said second inner protective shell comprises a first protuberance having a first outer edge inserted into the center opening of said at least one toroid-shaped damping element.

16. The protective helmet of claim 15, wherein said first inner edge of said first seat is solidly coupled to the outer crown of said at least one toroid-shaped damping element made of elastomeric material, and said first outer edge of said first protuberance is solidly coupled to the inner crown of said at least one toroid-shaped damping.

* * * * *